US006485265B2

(12) United States Patent
Schroeder et al.

(10) Patent No.: US 6,485,265 B2
(45) Date of Patent: Nov. 26, 2002

(54) VALVE FOR SENSING AT LEAST ONE CONDITION WITHIN A COMPRESSOR

(75) Inventors: David M. Schroeder, Newtown, PA (US); Steve Follmar, Houston, TX (US)

(73) Assignees: Coltec Industrial Products Inc., Charlotte, NC (US); Windrock Incorporated, Knoxville, TN (US)

( * ) Notice: Subject to any disclaimer, the term of this patent is extended or adjusted under 35 U.S.C. 154(b) by 103 days.

(21) Appl. No.: 09/733,142

(22) Filed: Dec. 8, 2000

(65) Prior Publication Data

US 2001/0031203 A1 Oct. 18, 2001

Related U.S. Application Data

(60) Provisional application No. 60/170,176, filed on Dec. 10, 1999.

(51) Int. Cl.[7] ..... F04B 39/10

(52) U.S. Cl. ..... 417/63; 417/440

(58) Field of Search ..... 417/63, 440, 442, 417/297, 454, 238, 434, 435, 504; 137/557, 854, 856

(56) References Cited

U.S. PATENT DOCUMENTS

| | | | | |
|---|---|---|---|---|
| 1,649,530 A | | 11/1927 | Holsinger | |
| 1,759,301 A | | 5/1930 | Dunn et al. | |
| 2,547,377 A | | 4/1951 | De Juhasz | |
| 3,651,827 A | | 3/1972 | Hammer et al. | |
| 4,081,171 A | | 3/1978 | Morgan et al. | |
| 4,111,041 A | | 9/1978 | Rice | |
| 4,325,128 A | | 4/1982 | Abnett et al. | |
| 4,456,963 A | | 6/1984 | Wiggins | |
| 4,466,290 A | | 8/1984 | Frick | |
| 4,740,140 A | | 4/1988 | Benson | |
| 5,112,196 A | | 5/1992 | Schuh | |
| 5,129,790 A | | 7/1992 | Ohnuma et al. | |
| 5,209,258 A | | 5/1993 | Sharp et al. | |
| 5,273,407 A | | 12/1993 | Jarchau et al. | |
| 5,406,979 A | * | 4/1995 | McHugh | 116/274 |
| 5,567,121 A | | 10/1996 | Peterson | |
| 5,846,056 A | | 12/1998 | Dhindsa et al. | |
| 6,182,692 B1 | * | 2/2001 | Fischer et al. | 137/557 |
| 6,189,563 B1 | * | 2/2001 | Taylor | 137/487.5 |

FOREIGN PATENT DOCUMENTS

| | | |
|---|---|---|
| AU | 164866 | 8/1955 |
| JP | 54019242 A | 3/1979 |

OTHER PUBLICATIONS

Bloch, "A Practical Guide to Compressor technology", McGraw–Hill, pp. 52–58.*

* cited by examiner

*Primary Examiner*—Charles G. Freay
(74) *Attorney, Agent, or Firm*—John M. Harrington; Kilpatrick Stockton LLP

(57) ABSTRACT

This present application discloses an improved valve configuration such that an indicator port is incorporated directly within the valve allowing a sensing device to be mounted directly to the valve or within the valve body, this application being directed to both suction and discharge valves which sense at least one condition within a compressor comprising a cylinder, a piston, at least one discharge valve, and at least one suction valve, the valve further including a valve guard, a valve seat, a hollow area adapted and configured for housing a sensing device and a sensing device disposed within the hollow area.

20 Claims, 5 Drawing Sheets

VALVE FOR SENSING AT LEAST ONE CONDITION WITHIN A COMPRESSOR

CROSS-REFERENCE TO RELATED APPLICATIONS

This application claims priority to U.S. Provisional Patent Application No. 60/170,176, filed Dec. 10, 1999, and is related to commonly owned U.S. Pat. No. 5,567,121, issued on Oct. 22, 1996, both of which are incorporated herein by reference to the extent that they are not inconsistent with the present application.

BACKGROUND OF THE INVENTION

The present application relates to stationary compressors as used in power plants, refineries, pipeline compression of natural gas, and other installations where gasses are compressed for industrial purposes, and more particularly to the in-service monitoring and analysis, such as electronic analysis, of the condition and performance of such compressors, and most particularly to suction and discharge valves that are adapted and configured for facilitating in-service monitoring.

An industrial reciprocating gas compressor is a positive-displacement machine wherein the gas to be compressed is trapped in an enclosed space and then squeezed into a small volume by the action of a piston moving inside a cylinder. The gas is compressed to a pressure sufficient to overcome the discharge pressure plus the spring tension holding the discharge valve closed, at which time the discharge valve opens and allows the compressed gas to leave the cylinder. Because of the nature of the reciprocating piston, compression ceases at the limits of its stroke, the discharge valve again closes due to the action of the springs on the valve, the piston reverses direction, and the small amount of gas remaining in the cylinder expands, increasing in volume and decreasing in pressure. When the inlet pressure is higher than the pressure inside the cylinder plus the spring tension holding the suction valve closed, the suction valve then opens, allowing gas to flow into the cylinder. At the opposite limit of the piston stroke, the suction valve closes due to the springs acting on the valve, the piston again reverses direction, and the compression cycle begins anew.

The rate of pressure rise with respect to piston position in the cylinder, the exact moment of valve actuation, actual pressures attained, and other information concerning the compression, discharge, re-expansion, and inlet events taking place in the cylinder have long been recognized to be of value to engineers in assessing the operating condition of compressors. The first instrument used to record such information was a mechanical device which comprised a stylus attached to a pressure indicator and a rotating drum which was activated in proportion to the movement of the piston by a string attached to the crosshead of the compressor. The instrument was attached to the cylinder with a three-way valve, and sensed pressures inside the cylinder via passages (indicator ports) drilled during manufacture of the compressor.

The state of the analyzing art advanced during the 1960s with the introduction of the BETA 100, an oscilloscope device that utilized pressure transducers to sense pressure through indicator ports, and determined piston location from the angle of the crankshaft of the compressor. Further refinements of such electronic analyzers have been based on the principles of the early devices, and now include displays of pressure/volume or pressure/time, automatic calculation of horsepower consumed by the cylinder, and volumetric efficiency of the cylinder, as well as analysis of each valve event. Data from vibration transducers and ultrasound detectors (for analyzing the behavior of individual valves) are routinely superimposed on the pressure-volume trace to pinpoint operational problems and to determine the need for maintenance. Data from the analyzer may be sent to a personal computers for the automatic generation of reports. Significant savings in operational expenses and maintenance costs are attainable if the information is analyzed at routine intervals.

There was a time gap between the use of the drum-and-stylus instruments and the modem electronic instruments, however, and during that time gap manufacturers stopped providing indicator ports in cylinders and usually did not list indicator ports as an option when ordering a new machine. As a result, many compressors currently in operation do not have indicator ports and therefore cannot be analyzed properly.

Detailed description of a more or less contemporary monitoring system for reciprocating piston machines, including the use of pressure transducers, is given by Wiggins in U.S. Pat. No. 4,456,963, the disclosure of which is herein incorporated by reference. Other references to the use of pressure monitoring are given by Rice in U.S. Pat. No. 4,111,041 and Abnett et al in U.S. Pat. No. 4,325,128, the disclosures of which are incorporated herein by reference. However, none of these references utilize pressure transducers to sense the cylinder pressure through the center bolt of a suction or discharge valve or disclose indicator ports incorporated within the valve body, as disclosed herein.

Installation of indicator ports after the manufacture of the compressor traditionally involves the complete disassembly of the compressor and tedious machine shop work to locate and drill the indicator ports. During this process, the compressor must remain out of service for extended periods of time with lost production costs accumulating. Often, the cylinder casting does not have provisions for adding an indicator port, and installing one may entail penetration and sealing the water jacket surrounding the cylinder. Without indicator ports, much of the intelligence necessary for analysis is lost. Thus, there is clearly a need for a simple and effective system and method to equip compressors that have not been manufactured with indicator ports with means for monitoring compressor cylinder condition and performance. Such systems and methods should provide a means for monitoring compressor performance without significantly increasing the space required to house the compressor and at the same time should provide adequate protection for the sensitive monitoring equipment.

SUMMARY OF THE INVENTION

This present application discloses an improved valve configuration such that an indicator port is incorporated directly within either a suction or a discharge type valve thereby allowing a sensing device to be mounted directly to the valve or within the valve body. It is generally understood that suction and discharge valves used in certain applications such as compressors, can be interchangeable and therefore, this application is directed to both of these types of compressor valves and the disclosure herein is applicable to both suction and discharge valves.

An object of the present application is to provide a simple and effective system and method to equip compressors with means for monitoring compressor cylinder condition and performance. Yet another object of the present application is to provide a location within the valve for the sensing device that inherently protects it from damage, enabling the device to function properly and increasing its expected service life.

Still yet another object of the present application is to simplify the installation of the sensing device by allowing it to be provided as part of a complete assembly. The sensing device can be provided already installed within a replacement valve for an existing compressor, or it can be provided as part of a valve assembly to be installed in a new compressor.

In accordance with these and further objects, one aspect of the present application includes a valve for sensing at least one condition within a compressor comprising a compressor cylinder, a piston, at least one discharge valve, and at least one suction valve. The valve includes a valve guard defining outlet flow ports and having a central aperture being disposed therein. The valve further includes a valve seat defining inlet flow ports and having a central aperture. An elongated structure such as an elongated stud is operatively engaged in the central aperture of the valve guard and valve seat and defines a central axis for the valve. The elongated structure has a hollow core which creates an indicator port extending from the interior of the compressor cylinder to an exterior terminus at the exterior of the valve. Additionally, a sensing device is operatively connected to the exterior terminus of the indicator port. The sensing device may comprises a pressure transducer for sensing pressure in the interior of the compressor cylinder. Alternatively, the sensing device may comprise a means for sensing the temperature, vibration, gas flow or the position of the piston within the compressor.

The present application is also directed to a valve for sensing at least one condition within a compressor comprising a compressor cylinder, a piston, at least one discharge valve, and at least one suction valve. The valve includes a valve seat defining inlet flow ports through which gas enters the valve and a valve guard defining outlet flow ports through which the gas exits the valve. A hollow area is operatively positioned in the valve guard or valve seat which is adapted and configured for housing a sensing device.

The valve further includes a bore in the valve seat for facilitating electrical communication with the sensing device. Electrical signal communicating structure, such as wiring, extends through this bore and connect the sensing device to a monitoring device. The monitoring device translates the signal received from the sensing device to data which can be interpreted by an operator, engineers or maintenance personnel in order to evaluate the condition and performance of the compressor. Preferably, the sensing device is a pressure transducer for sensing pressure in the interior of the compressor cylinder. Alternatively, the sensing device can be a means for sensing temperature or other condition within the interior of the compressor cylinder.

The present application is also directed to a system for sensing at least one condition within a compressor comprising a compressor cylinder, a piston, at least one discharge valve, and at least one suction valve. The valve includes a valve guard defining outlet flow ports, a valve seat defining inlet flow ports, a hollow area operatively positioned in the valve guard or valve seat, a sensing device operatively positioned within the hollow area, and a monitoring device located exterior to the valve in communication with the sensing device.

Other objects, features and advantages of the present application will be apparent from the following description, the accompanying drawings and the appended claims.

DETAILED DESCRIPTION OF THE INVENTION

Figure 1:
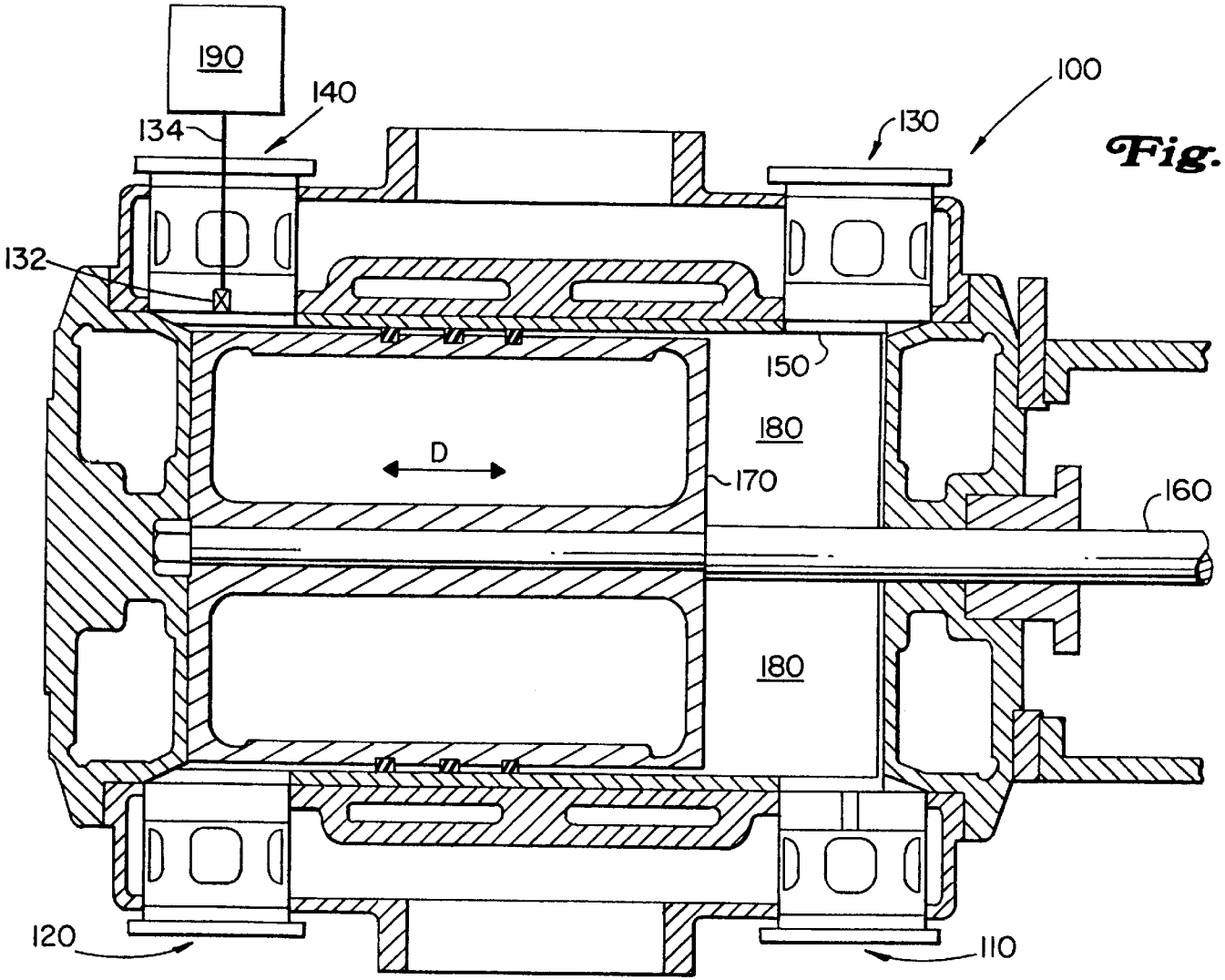
FIG. 1 is a cross-sectioned view of a reciprocating compressor which includes a cylinder, a piston, a piston rod, two suction valves, two discharge valves, a sensing device, and a monitoring device.

Referring now to the drawings where like reference numerals identify similar structural elements of the subject invention and flow arrows designated as I and O represent the direction of gas flow into and out of the valve respectively.

Illustrated in FIG. 1, is a system for sensing at least one condition within a reciprocating compressor constructed in accordance with the present application and designated generally by reference numeral 100. Compressor 100 includes suction valves 110 and 120, discharge valves 130 and 140, compressor cylinder 150, piston rod 160, piston 170, sensing device 132, and monitoring device 190.

In operation, gas 180 is trapped in an enclosed space between piston 170 and the compressor cylinder 150 and then squeezed into a small volume by the action of a piston 170 moving inside cylinder 150 as indicated by directional arrow D. The gas 180 is compressed to a pressure sufficient to overcome the discharge pressure plus the spring tension holding the discharge valve 130 closed, at which time the discharge valve 130 opens and allows the compressed gas to leave cylinder 150. Because of the nature of the reciprocating piston 170, compression ceases at the limits of its stroke, the discharge valve 130 again closes due to the action of springs on the valve 130, the piston 170 reverses direction, and the small amount of gas 180 remaining in the cylinder 150 expands, increasing in volume and decreasing in pressure, until the inlet pressure is higher than the pressure inside the cylinder 150 plus the spring tension holding the suction valve 110 closed. The suction valve 110 then opens, allowing gas 180 to flow into the cylinder 150. At the opposite limit of the piston 170 stroke, the suction valve 110 closes due to springs acting on the valve 110, the piston 170 again reverses direction, and the compression cycle begins anew.

As shown in FIG. 1, discharge valve 140 has a sensing device 132 disposed therein and wires or electrical signal communicating structure 134 operatively connected to sensing device 132 and monitoring device 190. The rate of pressure rise with respect to piston 170 position in the cylinder 150, and other information concerning the compression, discharge, and re-expansion taking place in the cylinder 150 is measured by sensing device 132 and transmitted to monitoring device 190, allowing engineer, operators or maintenance personnel to assess the operating condition and performance of compressor 100.

Figure 2:
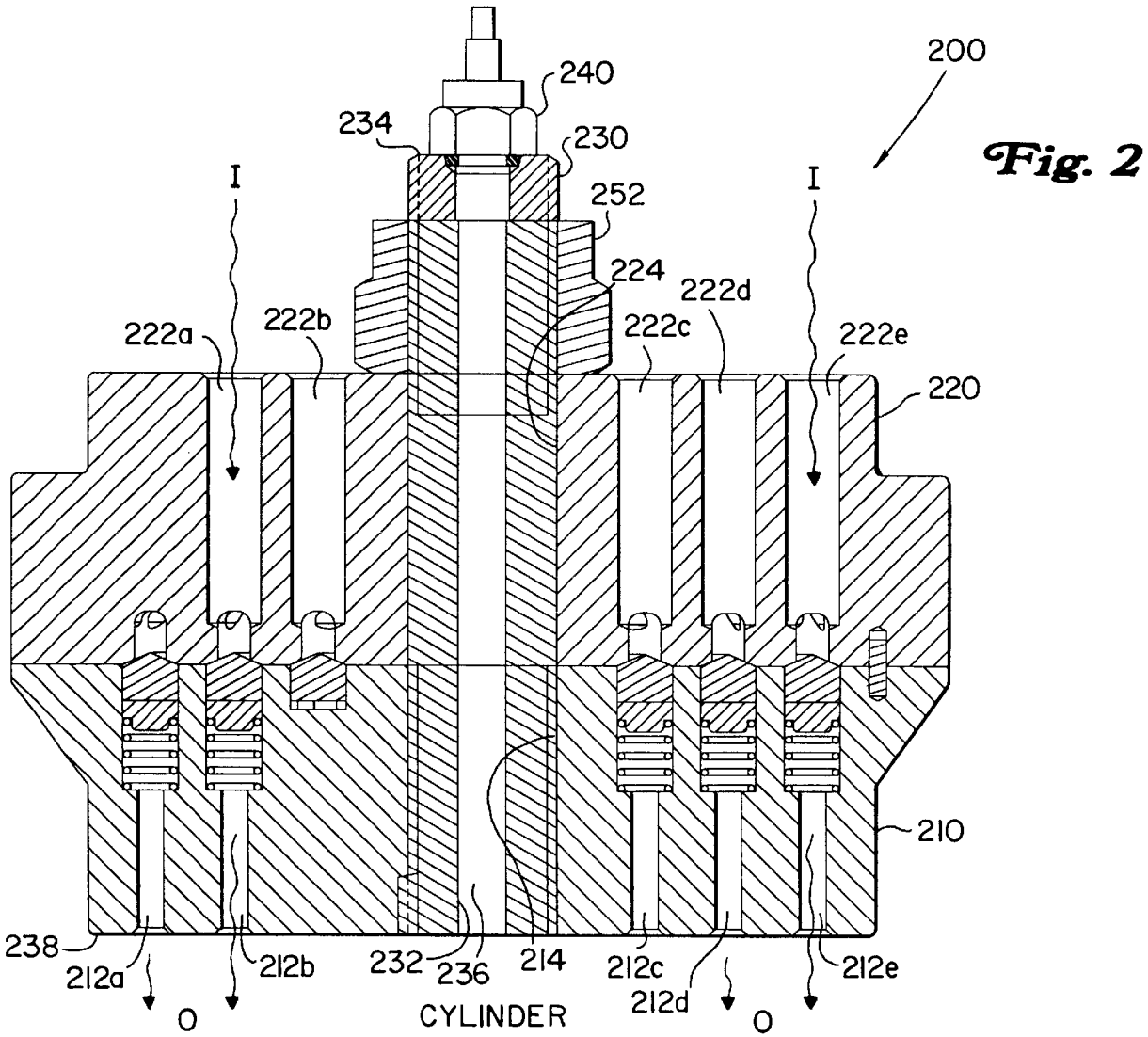
FIG. 2 is a cross-sectioned view of a suction valve having an elongated stud centered therein, the stud having a hollow core defining an indicator port and also having a sensing device operatively connected to the exterior terminus of the indicator port.

Referring now to FIG. 2, a specific valve for installation in a compressor that facilitates monitoring at least one condition within a compressor constructed in accordance with one embodiment and designated generally by reference numeral 200. As shown in FIG. 2, valve 200 operates as a suction valve for compressor 100 (see FIG. 1), allowing gas to be drawn into the compressor cylinder, and includes a valve guard 210 defining outlet flow ports 212*a*–212*e* and a central aperture 214. Valve guard 210 is operatively associated with the compressor cylinder at surface 238.

Valve 200 also includes a valve seat 220 defining inlet flow ports 222*a*–222*e* and a central aperture 224 adapted and configured for receiving elongated stud or elongated structure 230. Elongated structure 230 is positioned within central apertures 214 and 224 and provides a central axis for valve 200. Nut 252 is engaged on exterior terminus 234 of elongated structure 230 and connects valve guard 210 to valve seat 220. Elongated structure 230 has a hollow core 232 creating an indicator port 236 extending from surface 238 to exterior terminus 234 at the exterior of valve 200. Sensing device 240 is operatively connected to exterior terminus 234 of indicator port 236. Indicator port 236 allows sensing device 240 to sense at least one condition within the compressor 100 (see FIG. 1) by providing a conduit for the gas within the cylinder to reach sensing device 240. Sealing member 250 is operatively positioned between sensing device 240 and exterior terminus 234 and prevents the gas within indicator port 236 from escaping to the exterior of valve 200. In a preferred embodiment, sensing device 240 is a pressure transducer for sensing pressure internal to the compressor.

Figure 3:
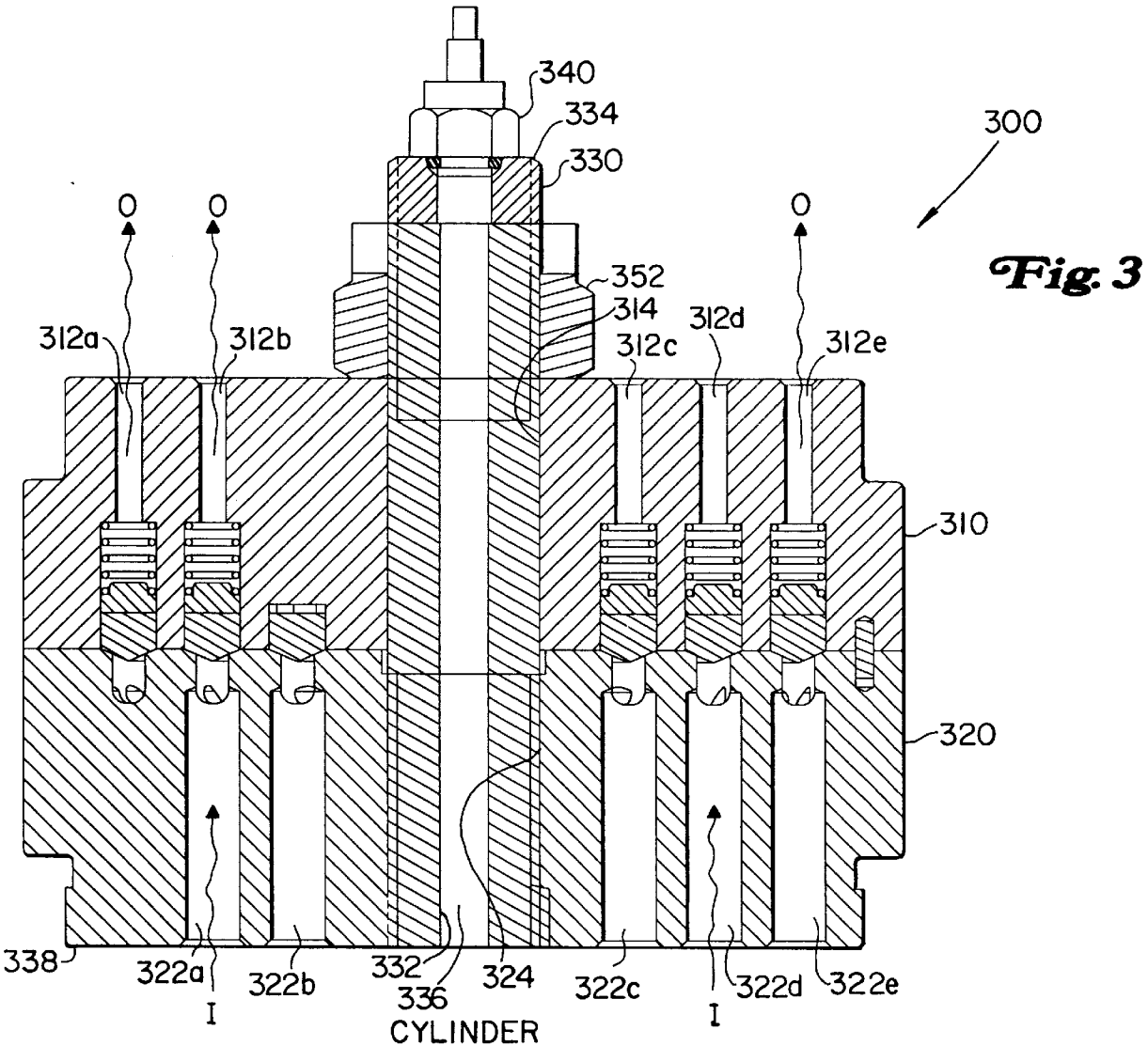
FIG. 3 is a cross-sectioned view of a discharge valve having an elongated stud centered therein, the stud having a hollow core defining an indicator port with a sensing device operatively connected to the exterior terminus of the indicator port.

Referring now to FIG. 3, a valve for installation in a compressor that facilitates sensing at least one condition within a compressor constructed in accordance with a second embodiment and designated generally by reference numeral 300. As shown in FIG. 3, valve 300 operates as a discharge valve for compressor 100 (see FIG. 1), allowing compressed gas to be discharged from the cylinder, and includes a valve guard 310 defining outlet flow ports 312*a*–312*e* and a central aperture 314.

Valve 300 also includes a valve seat 320 defining inlet flow ports 322*a*–322*e* and a central aperture 324 adapted and configured for receiving elongated stud 330. Elongated stud 330 is positioned within central apertures 314 and 324 and provides a central axis for valve 300. Valve seat 320 is operatively associated with the compressor cylinder at surface 338. As illustrated previously for suction valve 200 (see FIG. 2), elongated stud or elongated structure 330 has a hollow core 332 creating an indicator port 336 extending from surface 338 to exterior terminus 334. Also, sensing device 340 is operatively connected to exterior terminus 334 of indicator port 336. Indicator port 336 allows sensing device 340 to sense at least one condition within the compressor 100 (see FIG. 1) by providing a conduit for the gas within the compressor to reach sensing device 340.

Figure 4:
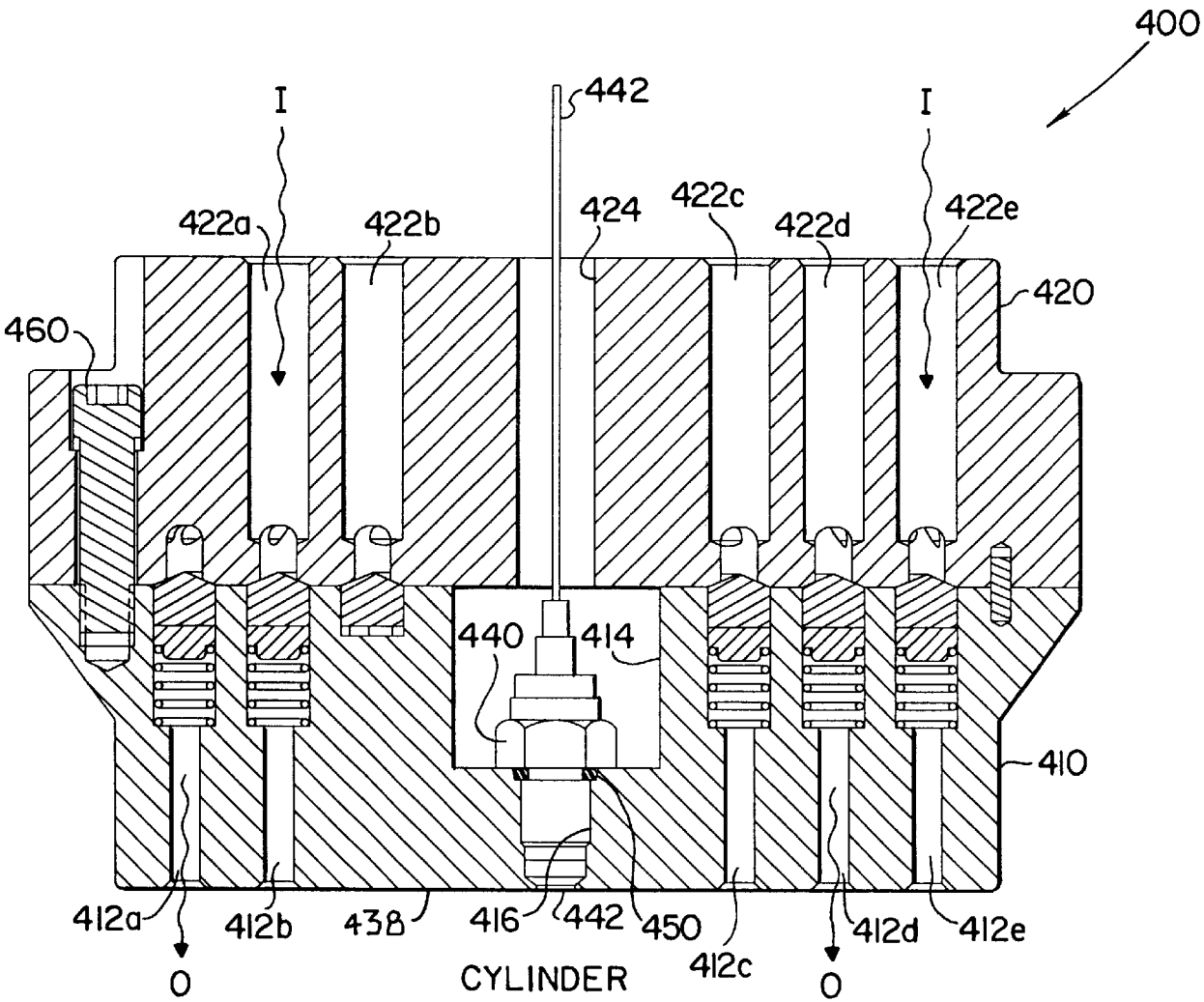
FIG. 4 is a cross-sectioned view of a suction valve having a valve guard having a hollow area in which a sensing device is housed.

Referring now to FIG. 4, there is illustrated a valve for sensing at least one condition within a compressor constructed in accordance with a third embodiment and designated generally by reference numeral 400. The valve 400 illustrated, operates as a suction valve for a compressor, allowing gas to be drawn into the compressor cylinder, and includes a valve guard 410 defining outlet flow ports 412*a*–412*e* and having a hollow area 414 disposed therein. Valve guard 410 is operatively associated with the compressor cylinder at surface 438.

Valve 400 also includes a valve seat 420 defining inlet flow ports 422*a*–422*e* and a central aperture 424. The hollow area 414 in valve guard 410 is adapted and configured for housing sensing device 440, hollow area 414 having a hole extending from its base, creating indicator port 416 and allowing sensing device 440 to sense conditions within the compressor cylinder at surface 438. Engagement pin 460 secures valve seat 420 to valve guard 410.

Valve 400 further includes a sealing member 450 operatively positioned in the space between sensing device 440 and hole 416. The sealing member 450 prevents gas internal to the compressor cylinder from entering into the hollow area 414 and exiting valve 400 through central aperture 424.

Presently it is preferred that sensing device 440 includes a transducer means for generating at least one signal as a function of pressure within the compressor cylinder. Alternately, the sensing device 440 may include a transducer for sensing the timing of the opening and closing of valve 400. Wires or electrical signal communicating structure 442 are in electrical connectivity with sensing device 440 and pass through central aperture 424 to a monitoring device 190 (see FIG. 1), transmitting a signal which is a function of the pressure within the compressor.

Figure 5:
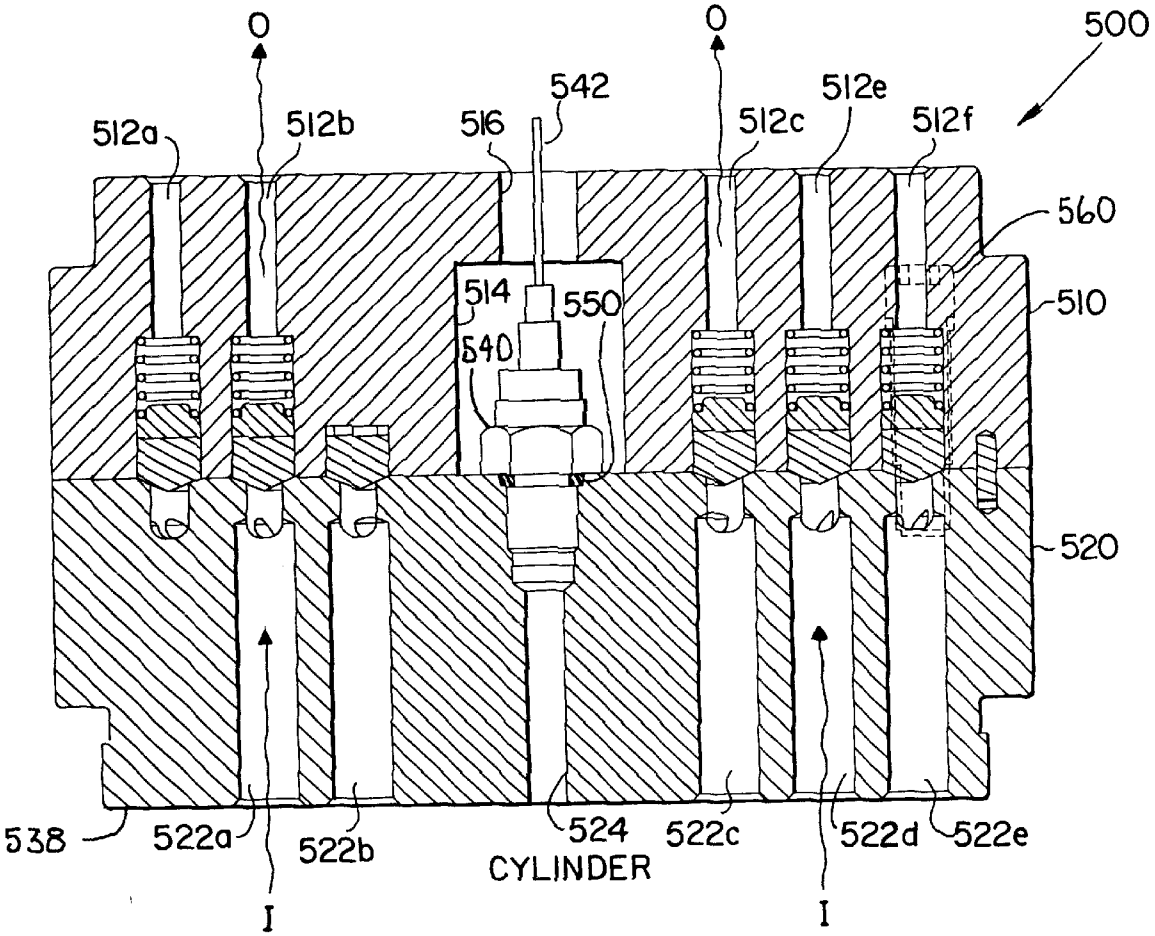
FIG. 5 is a cross-sectioned view of a discharge valve having a valve guard which includes a hollow area in which a sensing device is housed and a valve seat defining an indicator port.

Referring now to FIG. 5, there is illustrated a valve for sensing at least one condition within a compressor constructed in accordance with an fourth embodiment of the present application and designated generally by reference numeral 500. Valve 500 operates as a discharge valve for a compressor, allowing compressed gas to exit the compressor cylinder, and includes a valve seat 520 defining inlet flow ports 522*a*–522*e* and having an indicator port 524 disposed therein. Valve seat 520 is operatively associated with the compressor cylinder at surface 538.

Valve 500 also includes a valve guard 510 defining outlet flow ports 512*a*–512*e* and hollow area 514. Hollow area 514 in valve guard 510 is adapted and configured for housing sensing device 540, hollow area 514 having hole 516 which allows wires or other electrical signal communicating structure 542 to connect sensing device 540 to monitoring device 190 (see FIG. 1). Indicator port 524 allows sensing device 540 to sense conditions from within the cylinder of compressor 100 (see FIG. 1). Engagement pin 560 secures valve seat 520 to valve guard 510. Presently, it is preferable that sensing device 540 comprises a transducer means for generating at least one signal as a function of pressure within the compressor cylinder. Alternatively, sensing device 540 may include a transducer for measuring temperature, vibration, flow or the position of the piston within the compressor cylinder as would be understood by those skilled in the art.

It should be clear that the system, including the valve, and the methods disclosed herein have met the objectives of the present application. Specifically, the incorporation of indicator ports within a valve provide a simple and effective method for equipping compressors with means for monitoring compressor cylinder condition and performance. Additionally, locating the sensing devise within the valve inherently protects the device from being damaged as a result of a variety of conditions that may exist on the exterior of the compressor, thus increasing the sensors service life.

Still yet by providing indicator ports within the valve thereby allowing the sensing device to be installed directly on the valve stud or within the valve itself, the installation of the sensing device is simplified. These configurations allow it to be provided as part of a complete assembly with either a replacement valve or as part of a valve assembly to be installed in a new compressor.

While the articles and methods described herein constitute preferred embodiments of the present application, it is understood that the present application is not limited to the precise articles and methods and that changes may be made therein without departing from the scope of the present application which is defined by the appended claims.

What is claimed is:

1. A valve for sensing at least one condition within a compressor comprising a compressor cylinder, a piston, at least one discharge valve, and at least one suction valve, the valve comprising:

a valve guard defining outlet flow ports and having a central aperture being dimensioned for receiving an elongated aperture;

a valve seat defining inlet flow ports and having a central aperture dimensioned for receiving an elongated structure;

an elongated structure defining a central axis for the valve and having a hollow core creating an indicator port extending through the valve to an exterior terminus at the exterior of the valve, the elongated structure being engaged within the central aperture of the valve guard and valve seat; and a sensing device operatively connected to the exterior terminus of the indicator port;

wherein the valve comprises at least one of the at least one discharge valve and the at least one inlet valve.

2. The valve of claim 1, further comprising a nut engaged with the exterior terminus of the elongated structure, securing the valve seat to the valve guard.

3. The valve of claim 1, further comprising a sealing member disposed between the sensing device and the exterior terminus of the elongated structure.

4. The valve of claim 1, wherein the sensing device comprises a pressure transducer for sensing pressure in the interior of the compressor cylinder.

5. The valve of claim 1, wherein the sensing device comprises a transducer for sensing vibration.

6. The valve of claim 1, wherein the sensing device comprises a means for sensing temperature in the interior of the compressor cylinder.

7. The valve of claim 1, wherein the sensing device comprises a transducer for sensing gas flow through the valve.

8. The valve of claim 1, wherein the sensing device comprises a transducer for sensing the position of the piston within the cylinder.

9. The valve of claim 1, wherein the sensing device comprises a transducer for sensing the timing of valve opening and closing.

10. A valve for sensing at least one condition within a compressor comprising a compressor cylinder, a piston, at least one discharge valve, and at least one suction valve, comprising;

a valve guard defining outlet flow ports;

a valve seat defining inlet flow ports;

a hollow area operatively positioned in the valve guard or valve seat; and a sensing device operatively positioned within the hollow area.

11. The valve for sensing at least one condition within a compressor of claim 10, further comprising a hole in the valve seat or the valve guard for facilitating electrical communication with the sensing device.

12. The valve for sensing at least one condition within a compressor of claim 10, further comprising an indicator port in the valve seat.

13. The valve for sensing at least one condition within a compressor of claim 10, further comprising an indicator port in the valve guard.

14. The valve for sensing at least one condition within a compressor of claim 10, wherein the sensing device comprises a transducer for sensing gas flow through the valve.

15. The valve for sensing at least one condition within a compressor of claim 10, wherein the sensing device comprises a pressure transducer for sensing pressure in the interior of the compressor cylinder.

16. The valve for sensing at least one condition within a compressor of claim 10, wherein the sensing device comprises a transducer for sensing vibration.

17. The valve for sensing at least one condition within a compressor of claim 10, wherein the sensing device comprises a means for sensing temperature in the interior of the compressor cylinder.

18. The valve for sensing at least one condition within a compressor of claim 10, wherein the sensing device comprises a transducer for sensing the position of the piston within the cylinder.

19. The valve for sensing at least one condition within a compressor of claim 10, wherein the sensing device comprises a transducer for sensing the timing of valve opening and closing.

20. A system for sensing at least one condition within a compressor comprising a compressor cylinder, a piston, at least one discharge valve, and at least one suction valve, comprising:

a valve for sensing at least one condition within a compressor comprising:

a valve guard defining outlet flow ports;

a valve seat defining inlet flow ports;

a hollow area operatively positioned in the valve guard or valve seat;

a sensing device operatively positioned within the hollow area; and a monitoring device which is in communication with the sensing device.

* * * * *